United States Patent [19]

Janson

[11] 3,975,792

[45] Aug. 24, 1976

[54] DOUBLE TRACK DRAPERY GUIDE ASSEMBLY

[76] Inventor: Richard W. Janson, Box 8110, Canton, Ohio 44711

[22] Filed: Dec. 31, 1974

[21] Appl. No.: 537,694

[52] U.S. Cl. ..... 16/87.4 R; 16/96 D; 160/345

[51] Int. Cl.[2] ..... A47H 1/04

[58] Field of Search ..... 16/94 D, 95 D, 96 D, 16/87.4; 160/345, 346

[56] References Cited

UNITED STATES PATENTS

| | | | |
|---|---|---|---|
| 3,076,222 | 2/1963 | Sloan | 16/98 |
| 3,129,751 | 4/1964 | Weber | 16/94 D |
| 3,183,546 | 5/1965 | Heller et al. | 16/94 D |
| 3,697,035 | 10/1972 | Baker | 16/94 D |
| 3,715,776 | 2/1973 | Tanaka | 16/96 D |

FOREIGN PATENTS OR APPLICATIONS

| | | | |
|---|---|---|---|
| 398,910 | 3/1966 | Switzerland | 16/95 D |
| 1,241,576 | 6/1967 | Germany | 16/94 D |

*Primary Examiner*—Andrew V. Kundrat
*Attorney, Agent, or Firm*—Mason, Mason & Albright

[57] ABSTRACT

An assembly comprising a rod and parts for supporting drapery and the like, the rod having two identical tracks which extend longitudinally and receive movable hangers. The rod, composed of extruded aluminum, has the same cross-section throughout. The tracks are of rectangular cross section with a continuous slot along a bottom side, such side having a shorter width than the height of the vertical sidewalls of each track. A horizontal bar connects the tracks about midway on the adjacent sidewalls of the track, the bar having substantially the same width as each track. The bar is provided on its top and bottom with grooves of a V-configuration in cross-section, the grooves extending longitudinally and being centered relative to the width of the bar and providing for the centering of a drill bit for forming an opening for receiving fastening members.

22 Claims, 11 Drawing Figures

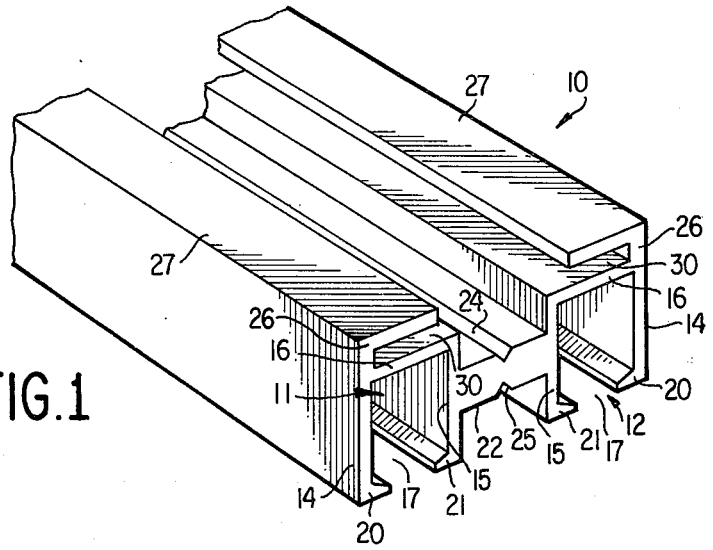
FIG.1
FIG.2
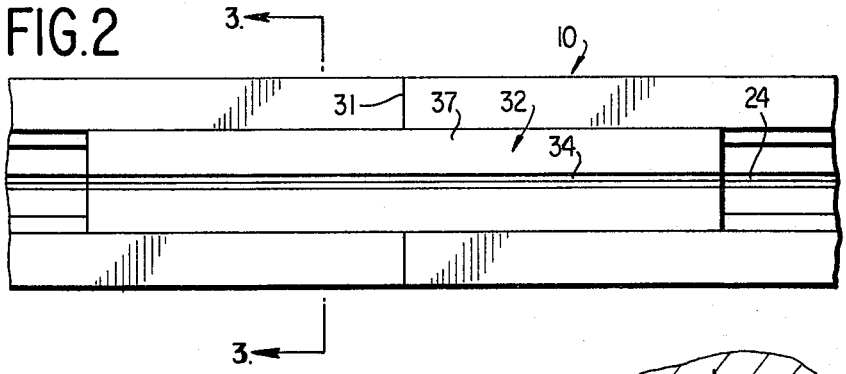
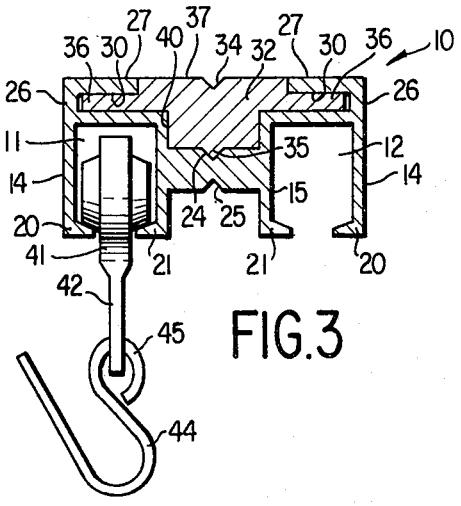
FIG.3
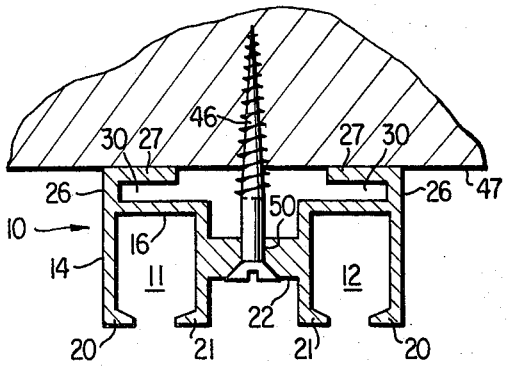
FIG.4
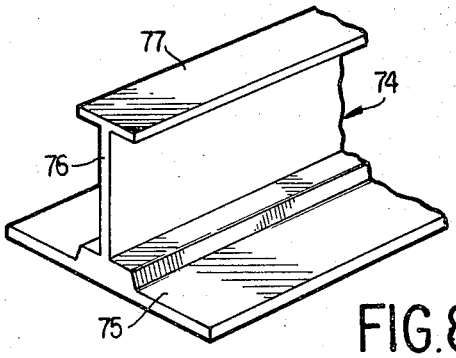
FIG.8

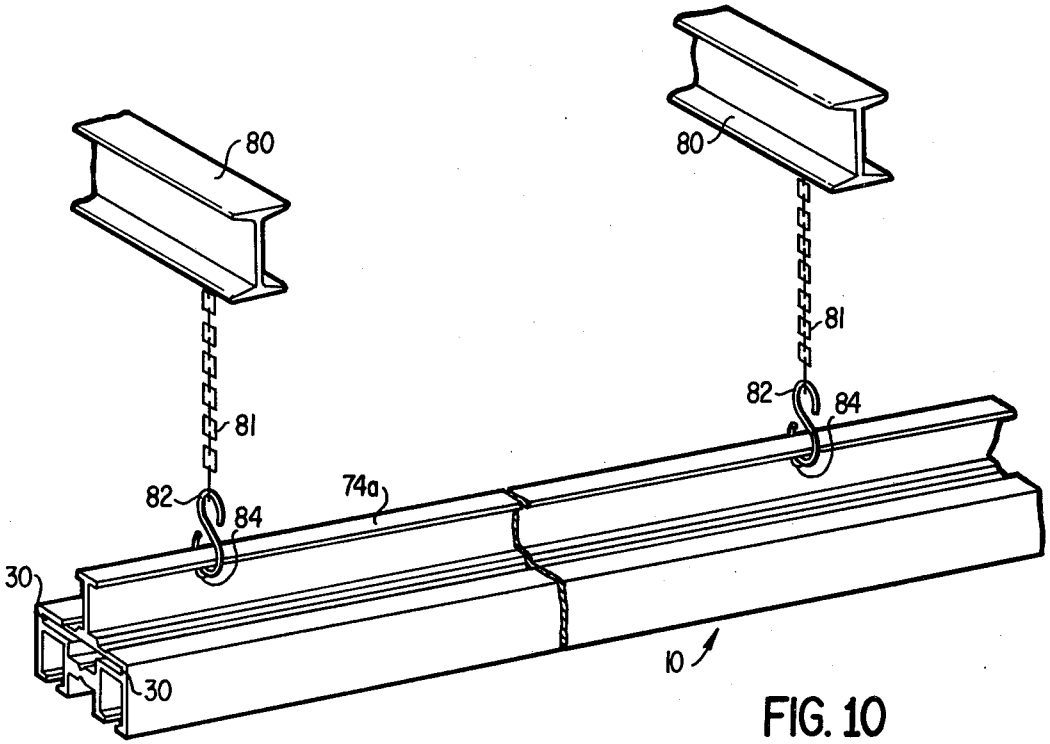
FIG. 10
FIG. 11
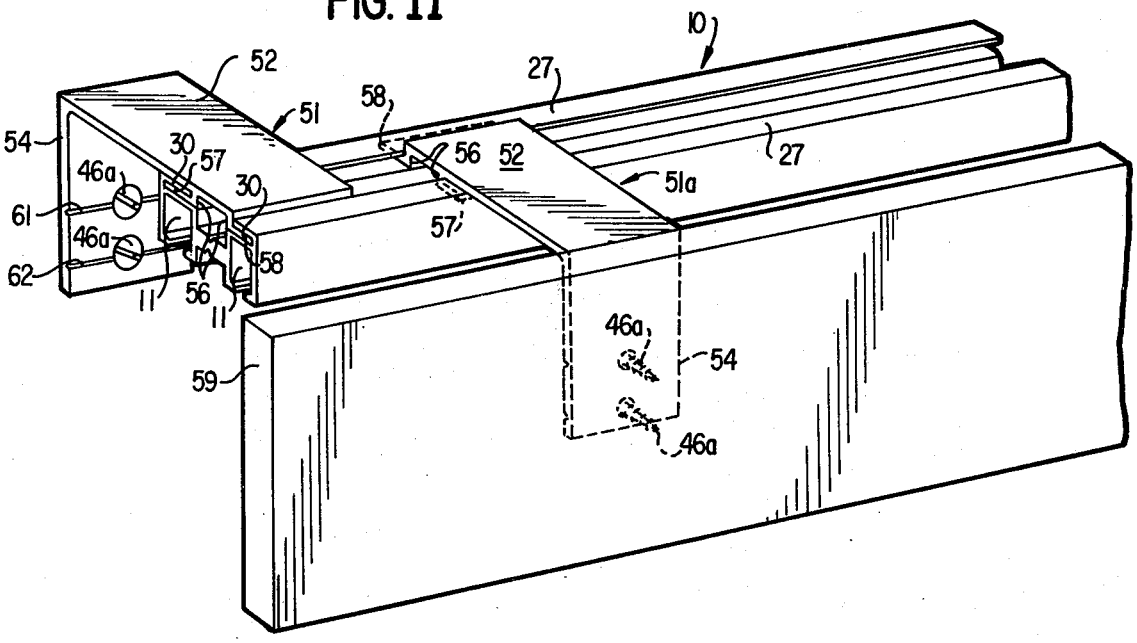

DOUBLE TRACK DRAPERY GUIDE ASSEMBLY

BACKGROUND OF THE INVENTION

There are many types and shapes for drapery tracks on the market and known as part of the prior art. One variety of such draperty tracks constitutes the double track system which finds important use in commercial facilities and institutions. The U.S. patents to Heller et al No. 3,183,546 May 18, 1965 and to G. Klein No. 3,518,806 of June 2, 1970 illustrates examples for double track systems. A problem which arises with such systems and to which each of the foregoing patents are directed concerns the installation of the systems in various architectural arrangements. A need exists and has existed for some time for a drapery rod assembly which is adaptable to the numerous architectural arrangements which may be encountered — particularly in commercial establishments and institutions.

SUMMARY OF THE INVENTION

The invention relates to a double track drapery traverse rod with associated parts for supporting the rod under various conditions with a substantial reduction in time for the installation.

The various components of my invention include the double track traverse rod, the rod including both the double drapery tracks and upper flanges whereby from the underside, a continuous slot exists between the longitudinal slots for receiving the drapery hangers and from the upper side recesses are provided for receiving brackets, clips and hangers and which is adaptable to receipt of splice bars to connect and align successive parts of the traverse rod in accordance with the invention. By means of the recesses provided in the top, a supporting bracket may be freely moved longitudinally with respect to the rod to such point where appropriate vertical surfaces are available for supporting the rod. With the use of ceiling clips which project upwardly from the rod, exposed flanges of the tees utilized in a conventional lay-in ceiling systems extensively used in contemporary buildings can be located to grasp the flange of such tees which are perpendicular to the length of the rod and it becomes possible to install rods without the use of any tools. The slot along the length of the upper portion of the rod is designed to permit the insertion of a splice bar where two rods sections abut together which effectively align the rods and eliminate binding of carriers at bad joints. Such splice bars permit the location of splices at any point along the length of the rod and also permit the storing of such rod in just a few lengths. Further a waste is eliminated inasmuch as pieces of the rod which are cut off can be subsequently used in conjunction with other short pieces together with the splice bars. Moreover, the invention permits installation without drilling or bolting or fasteners at places where the bracket splice or clamps may be located. The splice bars permit locating joints of the traverse rods at almost any place as desired rather than necessarily at a supporting bracket or bolting connecting or an oversleeve type connection.

The various components, which are limited in number, permit the device to be used in any orientation from vertical to horizontal. In addition, those installing the rods may do almost all or actually all of the work from below without the necessity of removing ceiling panels and thus the installation is possible by leaving the ceiling system intact. However, the system is adaptable to installations wherein the rod may be bolted to the ceiling or where the rod is hung by chains or the like from overhead structure as is common with rods for stage curtains.

From the foregoing it will be appreciated that the primary object of the invention is to provide a simplified and adaptable two-track drapery guide assembly, such assemblage, outside of the hangers and drapes, constituting essentially five parts each of which is manufactured of extruded aluminum or other extruded material.

Other objects, adaptabilities and capabilities of the invention will be appreciated by those skilled in the art as the description progresses, reference being had to the accompanying drawings.

BRIEF DESCRIPTION OF THE DRAWINGS

FIG. 1 is a broken perspective view of the traverse rod in accordance with the invention;

FIG. 2 is a plan view of the rod with a splice bar shown joining and aligning two of the traverse rod parts;

FIG. 3 is a cross-section taken on section lines 3—3 in FIG. 2;

FIG. 4 is a further cross-section illustrating the rod secured to a ceiling by direct fastening;

FIG. 8 shows in perspective a hanger member component in accordance with the invention;

FIG. 10 is a perspective view illustrating the use of an elongated hanger member in an installation similar to that shown in FIG. 9 which requires depending member; and FIG. 11 is a perspective view showing a hanger member in accordance with the invention in combination with two brackets as shown in FIG. 5 for mounting a valance, cornice or the like.

DESCRIPTION OF THE PREFERRED EMBODIMENTS

Figure 5:
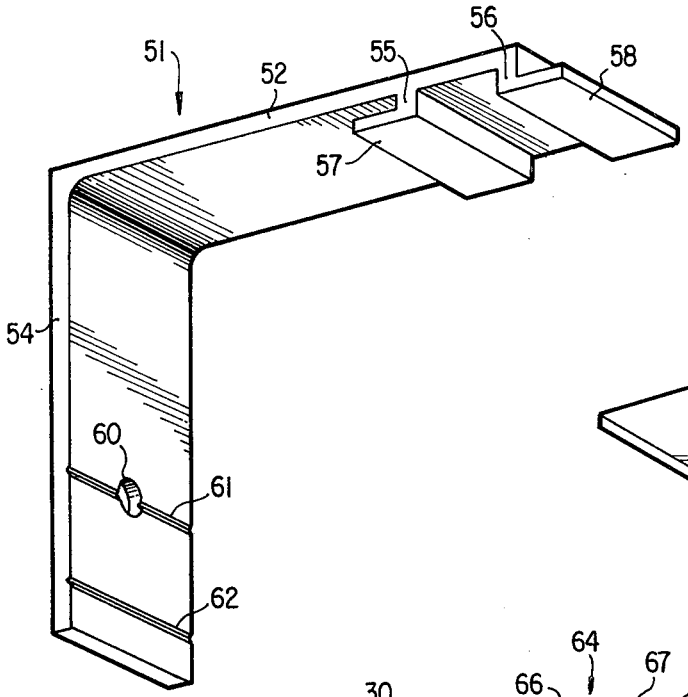
FIG. 5 is a perspective view of a bracket in according with the invention.

Referring to FIG. 1, the traverse bar designated generally by reference numeral 10 is provided with two tracks 11 and 12 each of which comprises outer vertical sidewalls 14 and inner vertical sidewalls 15 which are connected by an upper horizontal wall 16. Under wall 16 of each track 11 and 12 is a slot 17 which is defined by horizontal flange numbers 20 and 21 which extend inwardly from the vertical sidewalls 14 and 15 respectively. Connecting sidewalls 15 of each track 11 and 12 is an elongated horizontal bar 22 which is provided on its upper side with a groove 24 and on its lower side with a further groove 25. Extending upwardly from each sidewall 14 is a lug portion 26 from which an inwardly directed flange 27 defines a recess 30 with the underlying upper surface of the horizontal wall 16.

The outer corners defined by the corners of lug portions 26 and sidewalls 14 fall in the corners of a rectangle which has a width approximately double its height.

Also each track 11 and 12 is generally rectangular in shape with the vertical sidewalls 14 having a height which is greater than the width of the upper horizontal wall 16. The width of each flange 27 is about one-fourth of the overall width of the rod 10. The width of the horizontal bar 22 to sidewalls 15 is about the same as the width of each track 11 and 12 taken on the outside dimensions.

Referring to FIGS. 2 and 3, it will be noted that pair of rods 10 abut at location 31 and are connected by a splice bar 32. The splice bar 32 includes on its top a longitudinally extending and centered groove 34 which lies directly over a longitudinal protrusion 35 which corresponds to and fits within the groove 24. Splice bar 32 also includes a pair of horizontal wings 36 which are received snugly but slideably within the recesses 30. An upper part 37 extends between the inward edges of flanges 27, again the engagement being snug but slideable. It will be noted that the splice bar in cross section has a somewhat "T" configuration, the vertical part 40 being received between the upper part of sidewalls 15 and the upper surface of the horizontal bar 22 with an engagement which, as before, is snug but at the same time reasonably slideable.

Each track 11 and 12 is adapted to receive a plurality of movable supporting members 41 which include a depending hanger portion 42 with an aperture to receive a curtain hook 44 in its loop portion 45. The supporting member 41 conforms to a structural device disclosed in U.S. Pat. No. 3,076,222 of P. H. Sloan which issued Feb. 5, 1973.

In studying FIGS. 2 and 3, it will be understood that the splice bar 32 both connects and aligns the rods 10 together with the tracks 11 and 12 so that supporting members 41 may be moved therealong across location 31 without encountering a barrier.

The cross-sectional view shown in FIG. 4 of the rod 10 discloses the rod being directly fastened by means of a screw 46 to an overhead beam 47. To obtain this result, an opening 50 is drilled vertically through the horizontal bar 22 utilizing either the groove 24 or the further groove 25 to center the drill bit. In addition, the sides of groove 25 are so inclined to receive the tapered sides of the head of the flathead screw 46.

In FIG. 5 a bracket 51 having legs 52 and 54 at right angles to each other includes in the leg 52 a pair of short extensions 55 and 56 which extend horizontally to become flanges 57 and 58. It will be understood that the recesses 30 receive flanges 57 and 58 in a slideable but snug manner for supporting a rod 10 by affixing the bracket leg 54 to a vertical surface by means of screws or bolts received through a horizontal opening 60 which is drilled by using a groove 61 to assist in positioning a drill bit. A further groove 62 is provided for the same purpose.

Figure 6:
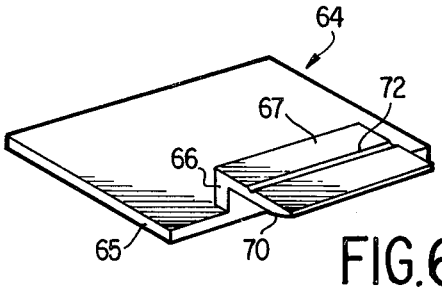
FIG. 6 shows a slip clamp which is part of the invention in perspective.
Figure 7:
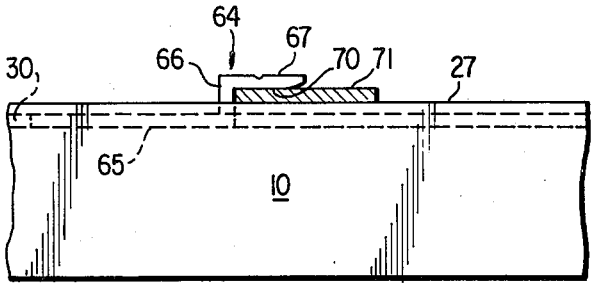
FIG. 7 is an elevational view showing the slip clamp and rod cooperating to receive a horizontal strip of a panel type ceiling support.

In FIGS. 6 and 7 a slip clamp 64 shown which includes a lower horizontal plate 65 adapted to be received snugly and slideably in the grooves 30 with a vertical extension 66 extending upwardly centrally from one edge of plate 64 to support a second plate 67 which is also horizontal and which has its underside 70 near the outboard edge beveled. The function of the slip clamp 64 is to receive horizontal ceiling members such as a horizontal strip 71 which is utilized for a panel ceiling, the rod 10 thereby being supported by means of the second plate 67 engaging the top side of the horizontal strip 71 and the upper surface of flanges 27 engaging the lower surface thereof to provide a snug clamping fit. It will be noted that the second plate 67 is provided with a groove 72 whereby if desired, a hole may be drilled through the second plate 67 either to augment or provide for securing of the slip clamp 64 to an overhead member such as horizontal strip 71. However, as a matter of practice this is seldom required for obtaining a sufficient overhead support for rod 10.

FIG. 8 illustrates a further hanger member 74 which has the form of an inverted "T" with a horizontal portion 75, a vertical portion 76 and a further horizontal piece 77 connected to the vertical portion 76 opposite horizontal portion 75. The horizontal portion 75 is so dimensioned that it is received longitudinally within the recesses 30 in a snug but slideable fit.

Figure 9:
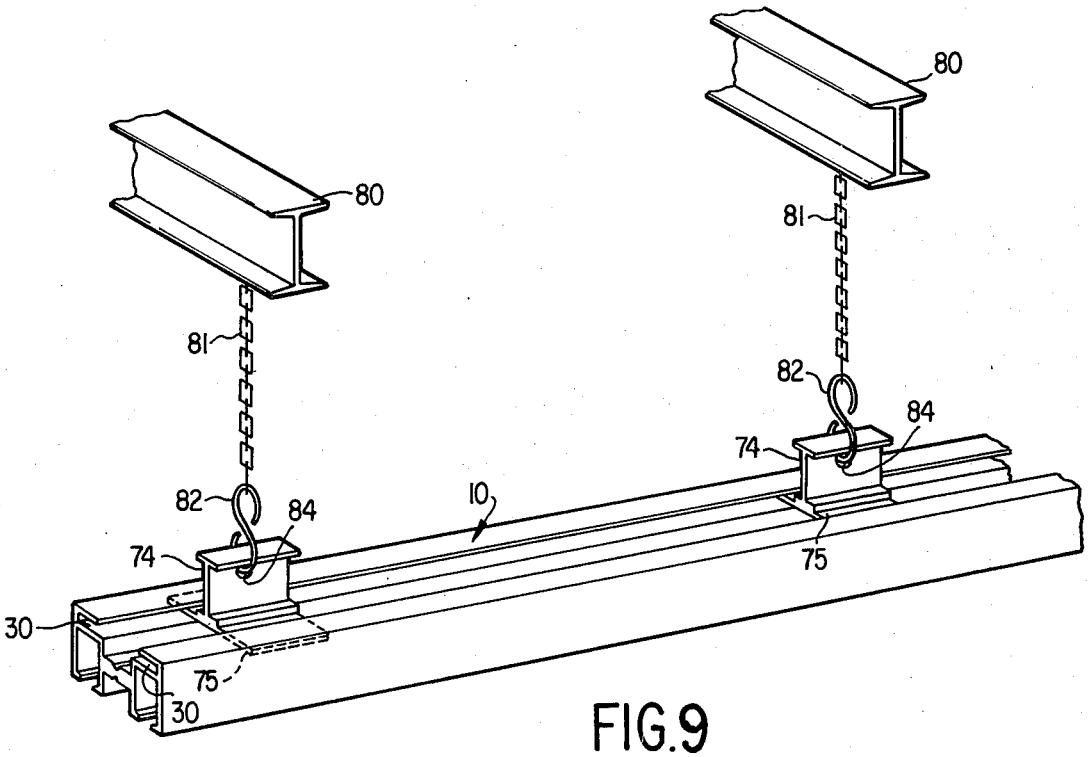
FIG. 9 is a perspective view illustrating use of the hanger member component in an installation which requires depending members.

FIG. 9 illustrates a use of hanger members 74 in short lengths in a manner common for stages. Thus a pair of overhead beams 80 have connected thereto and depending therefrom each a chain 81 which terminates with an S hook 82 which is received in its lower portion in an opening 84 drilled through the upper part of the vertical portion 76 of each hanger member 74, the horizontal portion 75 being received in recesses 30 of the supported rod 10. The advantage of this construction is that the hanger member 74 can be moved freely within the recesses 30 for alignment with whatever overhead support may exit such as the beams 80. The depending chain 81 may be substantially long say 20 feet and it will be understood that rod 10 is light in weight, an advantageous feature for elementary schools stages.

In a modification of the arrangement disclosed in FIG. 9, an elongated hanger member **74*a* (FIG. 10) which has a cross-section identical to hanger member 74 may be received in the continuous recesses 30 for the entire length of the operative rod 10. This has the advantage that it strengthens the structure whereby supports are needed less frequently than in the embodiment shown in FIG. 9 -- say every 8 feet on centers rather than every 4 feet. The hanger structure shown in FIG. 10 is also utilized advantageously for somewhat heavier drapes or stage curtains compared to that of FIG. 9.**

FIG. 11 illustrates how the invention may be employed to facilitate the field erection of valances or cornices. The drawing shows a bracket 51 secured to a wall by means of threaded screws **46*a* which are received through opening 60 and a further similar opening drilled through groove 62. Flanges 57 and 58 are received in recesses 30 which also receive the flanges 57 and 58 of an identical bracket designated in FIG. 11 as 51*a*. Bracket 51*a* has connected to its leg 54, by means of further threaded screws 46*a* received in openings in leg 54, a cornice board 59. Thus it will be appreciated that bracket 51 is secured rigidly to a wall through its leg 54 and supports, through its other leg 52 by means of flanges 57 and 58 and rod 10, the further bracket 51*a* which in turn has mounted thereon a cornice board 59. From FIG. 11,** those skilled in the art will understand the adaptability and versatility for various combinations of the cooperating parts disclosed herein.

An advantage of the assemblage described is that the rod 10, the bracket 51, the splice bar 32, the slip clamp 64 and the hanger member 74 are all capable of being formed by extrusion, preferably, as used in actual practice they are made of extruded aluminum. Also each part is constructed in a symmetrical manner whereby one side is a mirror image of the other side across a vertical center line. Accordingly, there is no difficulty with each part with the exception of the slip clamp in certain applications as to whether the part is correctly oriented in a fore and aft disposition.

It will be understood that the device in accordance with the invention may be utilized not only with drapery but also panels of a type which used as room dividers and the like.

Although I have described the preferred embodiment of my invention, it is to be understood that the disclosed assemblage is capable of the adaption and modifications particularly within the building industry as may fall within the ambit of the following claims.

Having thus described my invention, what I claim as new and desire to secure by Letters Patent of the United States is:

1. A traverse rod for supporting curtains and the like which comprises:

a pair of spaced apart elongated tracks, each track comprising an upper horizontal wall, a pair of vertical side walls depending from said upper wall, and horizontal flange members extending inwardly from each said side wall to define a slot, said flange members each receiving movable supporting members which include hanger means depending therefrom through said slot;

an elongated relatively thick single horizontal bar connecting said tracks in parallel rigid relationship, said bar including an elongated groove in its lower side midway between said tracks and parallel thereto, said tracks being separated except for the connection of said horizontal bar;

a lug extending upwardly from an outer sidewall of each said track, each said lug being elongated in a direction parallel to each said track and rigidly connected thereto, a pair of horizontal flanges, each said flange rigidly connected to said lug and extending inwardly towards the other said flange, said flanges with the upper horizontal walls of said tracks forming a pair of horizontally disposed recesses adapted to receive members for supporting the traverse rod, said lugs and said flanges comprising means structurally adapted for supporting the traverse rod and the curtains supported thereby.

2. A traverse rod in accordance with claim 1, comprising an extruded material having the same cross-section throughout.

3. A traverse rod in accordance with claim 2, wherein said material is a metal.

4. A traverse rod in accordance with claim 3, wherein said metal is aluminum.

5. A traverse rod in accordance with claim 1, wherein said horizontal flanges each have a width that is approximately one-fourth the overall width of the traverse rod and the space between the inner edges of said flanges has breadth equal to about one-half of the width of the traverse rod.

6. A traverse rod in accordance with claim 1, wherein said horizontal bar connects to each said track about midway along the inner wall of each said track.

7. A traverse rod in accordance with claim 1, wherein said recesses receive a hanger member, said hanger member having the cross-section of an inverted T wherein the horizontal portion thereof is received in said recesses and the vertical portion extends upwardly centered between and above said flanges.

8. A traverse rod in accordance with claim 7, wherein said hanger member is provided with a horizontal piece which extends along its top.

9. A traverse rod in accordance with claim 8, wherein said hanger member comprises an extruded material having the same cross-section throughout.

10. A traverse rod in accordance with claim 1, wherein said recesses receive a horizontal first plate, said first plate provided with an upstanding part received between and extending from between said flanges, whereby it is transverse to the longitudinal axes thereof, a second plate parallel to said first plate extending from said upstanding part above said flanges whereby a horizontal strip is receivable transverse to the rod above said flanges and below said second plate.

11. A traverse rod in accordance with claim 10, wherein said second plate includes an outer edge away from said upstanding part, said outer edge being perpendicular to the proximate inner edges of said flanges as seen from above, said outer edge being bevelled at its underside.

12. A traverse rod in accordance with claim 11, wherein said second plate is provided with a groove extending across it upper side.

13. A traverse rod in accordance with claim 1, wherein said recesses receive a relatively lengthy hanger member, said hanger member having a pair of oppositely extending members adapted to extend longitudinally for a relatively extended distance between said recesses, a depending member connected to said hanger member whereby said depending member supports the rod.

14. A traverse rod in accordance with claim 13, wherein said depending member comprises a chain.

15. A traverse rod for supporting curtains and the like which comprises:

a pair of spaced apart elongated tracks, each track comprising an upper horizontal wall, a pair of vertical side walls depending from said upper wall, and horizontal flange members extending inwardly from each said side wall to define a slot, said flange members each receiving movable supporting member which include hanger means depending therefrom through said slot;

an elongated horizontal bar connecting said tracks in parallel rigid relationship, said bar including an elongated groove in its lower side midway between said tracks and parallel thereto;

a lug extending upwardly from an outer sidewall of each said track, each said lug being elongated in a direction parallel to each said track and rigidly connected thereto, a pair of horizontal flanges, each said flange rigidly connected to said lug and extending inwardly towards the other said flange, said flanges with the upper horizontal walls of said tracks forming a pair of horizontally disposed recesses adapted to receive members for supporting the traverse rod;

a splice bar received in said horizontal recesses, said splice bar adapted to connect two like rods, said splice bar having a horizontal part which extends between and is received by said recesses and a vertical part which is closely received between the inner side walls of said tracks, the bottom of said vertical part being received by the top of said horizontal bar, whereby said splice bar has a T-shaped cross-section.

16. A traverse rod in accordance with claim 15, wherein said splice bar has a longitudinal groove midway across the top of its horizontal part.

17. A traverse rod in accordance with claim 15, wherein said splice bar comprises an extruded material having the same cross-section throughout.

18. A traverse rod in accordance with claim 17, wherein said horizontal bar has a further groove which extends longitudinally along its top side, said splice bar having a corresponding longitudinal protrusion which is received in said further groove.

19. A traverse rod for supporting curtains and the like which comprises:

a pair of spaced apart elongated tracks, each track comprising an upper horizontal wall, a pair of vertical side walls depending from said upper wall, and horizontal flange members extending inwardly from each said side wall to define a slot, said flange members each receiving movable supporting members which include hanger means depending therefrom through said slot;

an elongated horizontal bar connecting said tracks in parallel rigid relationship, said bar including an elongated groove in its lower side midway between said tracks and parallel thereto;

a lug extending upwardly from an outer sidewall of each said track, each said lug being elongated in a direction parallel to each said track and rigidly connected thereto, a pair of horizontal flanges, each said flange rigidly connected to said lug and extending inwardly towards the other said flange, said flanges with the upper horizontal walls of said tracks forming a pair of horizontally disposed recesses adapted to receive members for supporting the traverse rod;

a bracket received in said recesses for supporting the rod, said bracket having two legs disposed at right angles relative to each other and being L-shaped in cross-section, one of said legs including a pair of short extensions parallel to and extending in the same direction as the other said leg of said bracket, said extensions being provided with flanges extending therefrom in opposite directions and corresponding in cross-section to said recesses in which they are received.

20. A traverse rod in accordance with claim 19, wherein said bracket comprises an extruded material, a groove being provided in said leg not received by said recesses which is parallel to said tracks.

21. A traverse rod in accordance with claim 20, wherein a further bracket similar to said first-mentioned bracket is received in said recesses, a horizontally disposed leg of said second bracket extending outwardly from said recesses in a direction opposite to said one leg of said first-mentioned bracket, said further bracket including mounting means for mounting a further structural member spaced from the traverse rod.

22. A traverse rod for supporting curtains and the like which comprises:

a pair of spaced apart elongated tracks, each track comprising an upper horizontal wall, a pair of vertical side walls depending from said upper wall, and horizontal flange members extending inwardly from each said side wall to define a slot, said flange members each receiving movable supporting members which include hanger means depending therefrom through said slot;

an elongated horizontal bar connecting said tracks in parallel rigid relationship, said bar including an elongated groove in its lower side midway between said tracks and parallel thereto, said horizontal bar having a further groove which extends longitudinally along its top side opposite said first-mentioned groove;

a lug extending upwardly from an outer sidewall of each said track, each said lug being elongated in a direction parallel to each said track and rigidly connected thereto, a pair of horizontal flanges, each said flange rigidly connected to said lug and extending inwardly towards the other said flange, said flanges with the upper horizontal walls of said tracks forming a pair of horizontally disposed recesses adapted to receive members for supporting the traverse rod.

* * * * *